United States Patent [19]

Giori

[11] Patent Number: 4,584,939

[45] Date of Patent: Apr. 29, 1986

[54] COMBINED ROTARY PRINTING MACHINE

[75] Inventor: Gualtiero Giori, Lonay, Switzerland

[73] Assignee: De la Rue Giori S.A., Switzerland

[21] Appl. No.: 622,988

[22] Filed: Jun. 21, 1984

[30] Foreign Application Priority Data

Jul. 26, 1983 [CH] Switzerland ..... 4086/83

[51] Int. Cl.[4] ..... B41F 5/16; B41F 9/02; B41F 11/00

[52] U.S. Cl. ..... 101/152; 101/177; 101/179; 101/DIG. 22

[58] Field of Search ..... 101/152, 153, 177, 174, 101/179, DIG. 22, 175

[56] References Cited

U.S. PATENT DOCUMENTS

| | | | |
|---|---|---|---|
| 1,123,455 | 1/1915 | Wood | 101/152 |
| 1,934,776 | 11/1933 | Stoessel | 101/152 |
| 2,283,501 | 5/1942 | Huck | 101/152 X |
| 3,390,631 | 7/1968 | Koszul | 101/155 |
| 4,056,056 | 11/1977 | Giori | 101/152 |
| 4,421,027 | 12/1983 | Fischer | 101/179 X |
| 4,441,423 | 4/1984 | Germann | 101/175 |

FOREIGN PATENT DOCUMENTS

| | | | |
|---|---|---|---|
| 641543 | 5/1962 | Canada | 101/152 |
| 0091709 | 10/1983 | European Pat. Off. | 101/152 |
| 0092887 | 11/1983 | European Pat. Off. | 101/175 |
| 0108143 | 6/1983 | Japan | 101/177 |
| 480175 | 12/1969 | Switzerland | 101/152 |
| 2094718 | 9/1982 | United Kingdom | 101/177 |

*Primary Examiner*—Clifford D. Crowder

*Attorney, Agent, or Firm*—Kane, Dalsimer, Kane, Sullivan and Kurucz

[57] ABSTRACT

The machine comprises an indirect printing device, a drying device, a sheet transfer and turning device actuated according to requirements, and an intaglio printing machine. It permits of printing—in a single pass—through device a simultaneous recto-verso printing, namely on one side according to the color collecting printing method, an image with juxtaposed colors, and on the other side according to the offset printing method an image with superposed colors and designs, notably for creating safety background on bank notes, and after drying and, if necessary, turning the sheets, an image printed by intaglio printing on one of the sides, notably for creating a main design on the bank note. The multicolor printing on the side receiving the image with juxtaposed colors may be completed in device by a monochrome wet offset printing. Moreover, a register control device may be incorporated between the sheet transfer and turning device and the intaglio printing machine.

8 Claims, 5 Drawing Figures

26
37
D
38
36
35
33a
40a
29a
40a

A
43
45
44
4
3
18
5
10
4
9
11
12
19
20
17
16

C
26
26a
41
42
27
E
D
37

COMBINED ROTARY PRINTING MACHINE

FIELD OF INVENTION

The invention relates to a combined sheet-fed or web-fed rotary printing machine, notably for printing fiduciary papers, which comprises a device for the indirect multicolor printing, an intaglio printing machine comprising a plate cylinder inked in several colors which cooperate with a wiping device and an impression cylinder, and a paper transfer system feeding the printed paper from the indirect printing device to the intaglio printing machine.

PRIOR ART

Such a combined machine is known through the Swiss Pat. No. CH-A-566.210 and comprises as an indirect printing device a multicolor offset printing machine for printing one side of the paper, the latter being subsequently transferred to the intaglio printing machine for performing the multicolor direct printing on the same side of the paper. This machine is intended, preferably, in the field of bank note manufacture, for printing in a single pass firstly on one side of the paper a safety background in the offset printing mode and, after that on the same side, a main design printed in the intaglio mode; for terminating the printing of the bank notes, a second machine for printing the other side must be used.

The offset or indirect typographic printing method produces a printing with superposed colors and designs which is frequently utilized for printing safety backgrounds. According to this method, the complete design consists of partial designs in different colors carried by offset printing plates mounted on plate cylinders so as to permit the superposition of designs and colors in proper register with one another on a blanket cylinder against which the paper to be printed is pressed. The number of printing plates and consequently of plate cylinders corresponds to the number of different colors and designs constituting the multicolor image.

Offset machines of this type are also known for simultaneous recto-verso printing, wherein the paper is moved between two blanket cylinders receiving each a multicolor image from corresponding plate cylinders.

On the other hand, a printing machine adapted to print on one side of the paper an image with juxtaposed colors is also known. This image is printed by means of a single typographic printing plate mounted on a plate cylinder and representing the complete design to be printed. This typographic plate is inked by a collecting cylinder consisting of a blanket cylinder inked in turn by a plurality of selective color inking cylinders of which the number corresponds to the number of colors of the images to be printed. Each selective color inking cylinder comprises relief cut areas representing the portions of the image to be colored in a predetermined color received by this cylinder from its inherent inking device. With this method, commonly referred too as the "Orlof" method or collect-printing of colors, a multicolor image is obtained which ensures a perfect register between the different colors of the image design, a result that cannot be obtained with any other printing method. Since the selective color inking cylinders are in contact with a resilient surface of the collecting cylinder, they can be manufactured from hard material, thus permitting of cutting very fine relief areas and therefore very fine colored areas, for example in the form of lines or points. This machine is also intended for printing the safety background of bank notes.

In the present state of the art, machines have been developed which exploit each separately one or the other of the offset or "Orlof" methods disclosed hereinabove.

SUMMARY OF THE INVENTION

The object of this invention is to create a combined machine permitting the exploitation of three definitely different printing methods, namely the offset printing the "Orlof" printing and the intaglio printing by means of only one pass of the paper, preferably for printing fiduciary papers, notably bank notes, for applying simultaneously multicolor backgrounds on both sides and at least one main design on one of the sides by the intaglio printing method. Thus, the invention permits of producing bank notes very difficult to counterfeit. Moreover, this machine should permit, without any difficulty, of introducing several changes into the printing combinations.

To achieve this purpose, the invention is characterized by a machine as disclosed in claim 1.

The advantage of this machine consists in that it permits, on the one hand, of exploiting two completely different methods for a simultaneous offset-"Orlof" printing on both sides, whereby the two sides of bank notes and other fiduciary papers may receive multicolor printed safety backgrounds of different types, and on the other hand, of completing a selected side with an intaglio printing representing the main design for fiduciary papers. This increases safety against counterfeiting and furthermore makes the printing operations more economical because the printing of bank notes can thus be completed in a single pass. Moreover, this machine affords the user very interesting, sophisticated and hitherto unattainable possibilities of changes in the printing combinations.

Advantageous forms of embodiment of the invention are described in the dependent claims.

The invention will be described by way of non-limiting example through one form of embodiment and several modifications with reference to the attached drawing.

DESCRIPTION OF THE PREFERRED EMBODIMENTS

Figure 1A:
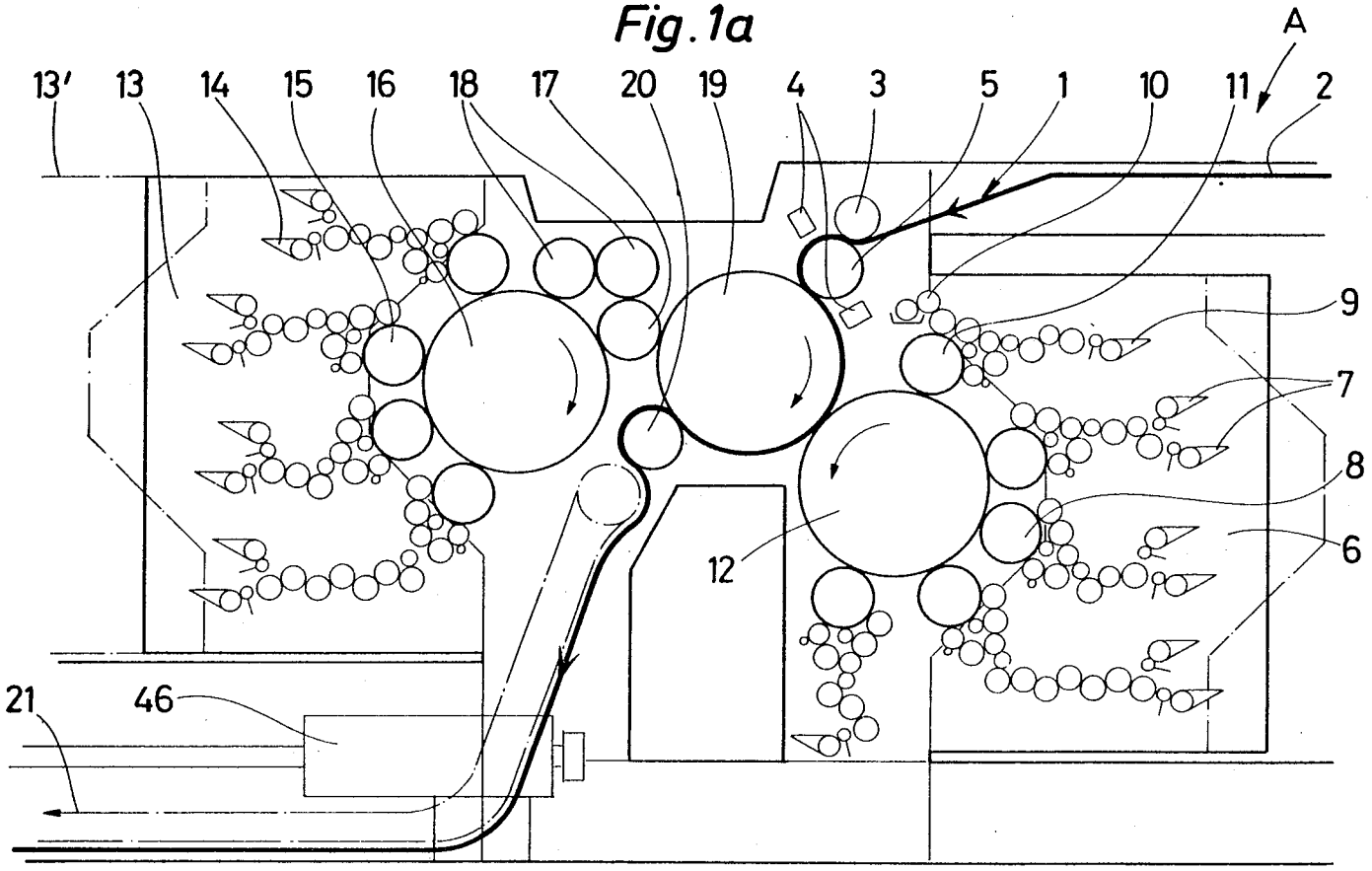
FIGS. 1*a* and 1*b* show a sheet-fed printing machine according to the invention, the right-hand half with the indirect printing device being in FIG. 1*a*, the other half with the sheet drying and turning devices as well as the intaglio machine being in FIG. 1*b*.
Figure 1B:
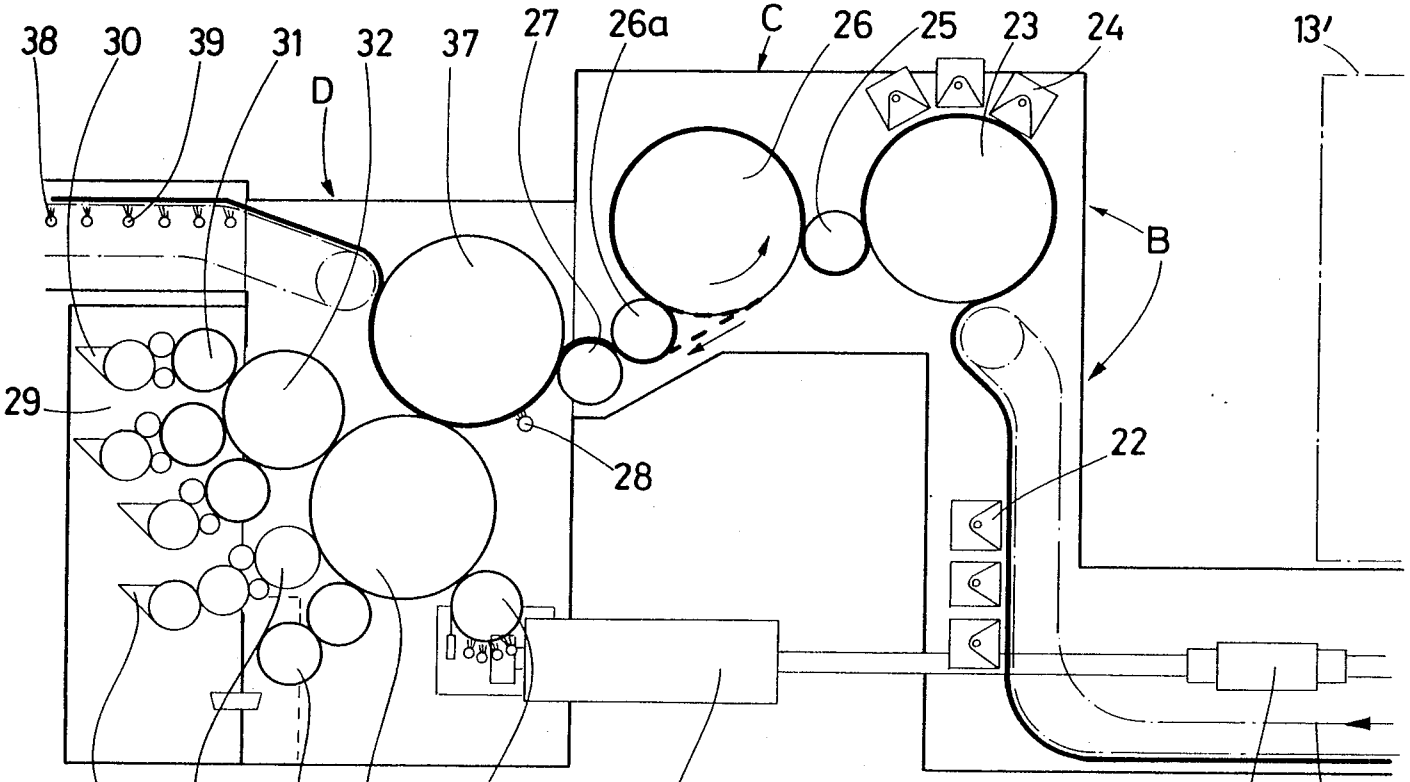

According to FIGS. 1*a* and 1*b*, the machine comprises an indirect printing device for applying simultaneously an offset printing on one side of a sheet 1 (the right-hand side as shown in FIG. 1*a*) and an "Orlof"

printing on the other side of this sheet which is delivered from a non-stop stream-feeder, of known type, along the path 2. Then, the sheets are fed by a conveyor system, via a drying device B (FIG. 1*b*) and a transfer and sheet turning unit C (FIG. 1*b*), to an intaglio printing machine D (FIG. 1*b*), from whence the printed sheets are delivered by a chain gripper system 38 to output piles, said sheets receiving air on the freshly printed side by means of air blasts 39.

The drive motor 46 for the indirect printing device A, the drive motor 47 for the intaglio printing machine D and the drive shaft with a coupling 48 of known type (FIG. 1*b*) for compensating the torques of the two machines and separating these machine for maintenance purposes, are shown diagrammatically.

The indirect printing device A (FIG. 1*a*) comprises an input device for the sheets fed along the path 2, which comprises a stop drum 3, a transfer drum 5 provided with grippers, and dust and static electricity eliminators 4 installed on both sides of sheets 1. The sheets are transferred on a blanket cylinder 19 provided with grippers and pressed against another blanket cylinder 12 of same diameter. The sheets pass between these blanket cylinders 12 and 19 and are printed simultaneously on both sides. The cylinders rotate in the direction shown by the arrows. After having been printed, the sheets are transferred by another chain gripper device 21 to the other devices to be described below.

The blanket cylinder 12 cooperates with five offset plate cylinders of which four offset plate cylinders are each provided, in the example considered herein, with a dry offset printing plate each inked by an inking unit with double duct 7; the fifth offset plate cylinder 11 carries a wet offset printing plate inked by an inking unit with single duct 9 and provided with a dampening unit 10. All these elements 7 to 11 are installed on a movable offset inking carriage 6.

The dry offset printing plates are typographic plates known per se and the wet offset printing plate is an intaglio plate also known per se. These five offset plates represent partial designs which are inked in the different colors and of which the number corresponds to the number of colors and designs of the first image to be printed on one side of sheets 1.

This image is notably a safety background in the case of fiduciary papers, notably bank notes.

These partial designs of different colors are combined on blanket cylinder 12 operating as an offset blanket cylinder, therefore as a collecting cylinder for the partial designs constituting the multicolor image. This image is transferred to one side of the sheets, where a four-color dry offset printing completed by a monochrome wet offset printing is obtained.

In the case of fiduciary papers one may also use four dry offset plate cylinders 8 for producing a four-color background, while the wet offset plate cylinder 11 represents a main design or one portion thereof.

Of course, for the offset printing all the plate cylinders mounted on the movable carriage 6, that is, in the example considered herein, all the five plate cylinders, can also be equipped with dry offset plates.

On the other side of device A the elements for producing an "Orlof" image are provided. These elements comprise a blanket cylinder 16 having the same diameter as blanket cylinders 12 and 19. This blanket cylinder 16 cooperates in the example illustrated with four selective color inking cylinders 15 having relief areas cut according to the contour of the areas to be printed in the respective color; they are inked in said color, each, by means of an inking unit 14 with double duct. These elements 14,15 are installed on a movable "Orlof" inking carriage 13 (of which the retracted position 13' is shown in dash and dot lines). These selective cylinders 15 are made preferably from hard material not prone to undergo any distortion even if the relief is very fine, whereby a safety background consisting of very fine color areas can be obtained.

The four color areas are transferred on blanket cylinder 16 operating as a color collecting cylinder on which they are combined and by which they are transferred to a plate cylinder 17 carrying a typographic printing plate contacting said collecting cylinder 16 and blanket cylinder 19. This typographic plate represents the complete design of the second image to be printed in four colors on the other side of the sheet. The complete image inked in the different colors is transferred in turn to blanket cylinder 19 for applying the printing of the complete image, notably a safety background, on the other side of the sheets, therefore on the left-hand side as seen in FIG. 1*a*, while the right-hand side receives simultaneously the offset image. During the simultaneous printing both cylinders 12 and 19 act mutually as counterpressure cylinders.

The device A further comprises two image transfer cylinders 18 for transmitting the same image from the colored areas of blanket cylinder 16 in perfect register with the typographic plate cylinder 17, thus permitting of reinforcing the inking of the typographic plate in the desired colors and consequently of better covering these areas with the desired ink. In fact, considering the direction of rotation of blanket cylinders 16, one portion of the ink is transferred by cylinders 18 to the typographic plate cylinder 17 while the remaining portion of the ink is transferred in perfect registration directly to said cylinder 17. The arrangement of the cylinders concerned for obtaining this double inking features is known (DE-A-3,109.964), the second inking step being shifted by the length of the periphery of typographic plate cylinder 17 or, in the example considered herein, by one-third of the periphery of blanket cylinder 16 because the latter has a diameter which is three times greater than that of cylinder 17 and carries three blankets.

To meet this registration requirement, the arrangement of cylinders 16,17 and 18 is such that the sum of the arc lengths measured on the periphery of cylinders 18 and 17 between the respective points of contact—as seen in the direction of rotation of these cylinders—must be equal to the arc length measured on the periphery of cylinder 16 between the points of contact of this cylinder with the first cylinder 18 and the cylinder 17, plus one-third of the periphery of this cylinder 16.

If the design carried by the typographic plate for the "Orlof" printing consists only of lines, therefore of very narrow inked areas, one may dispense with the image transfer cylinders 18 and limit oneself to a simple inking of the typographic "Orlof" plate.

In the example illustrated the ratio of the diameters of cylinders 8,11,15,17 and 18 on the one hand to the diameters of cylinders 12,16 and 19 on the other hand is 1:3, the periphery of cylinders 12,16 and 19 corresponding thus to three paper sheets; each one of these cylinder carries three blankets.

Figures 2, 3, 4:
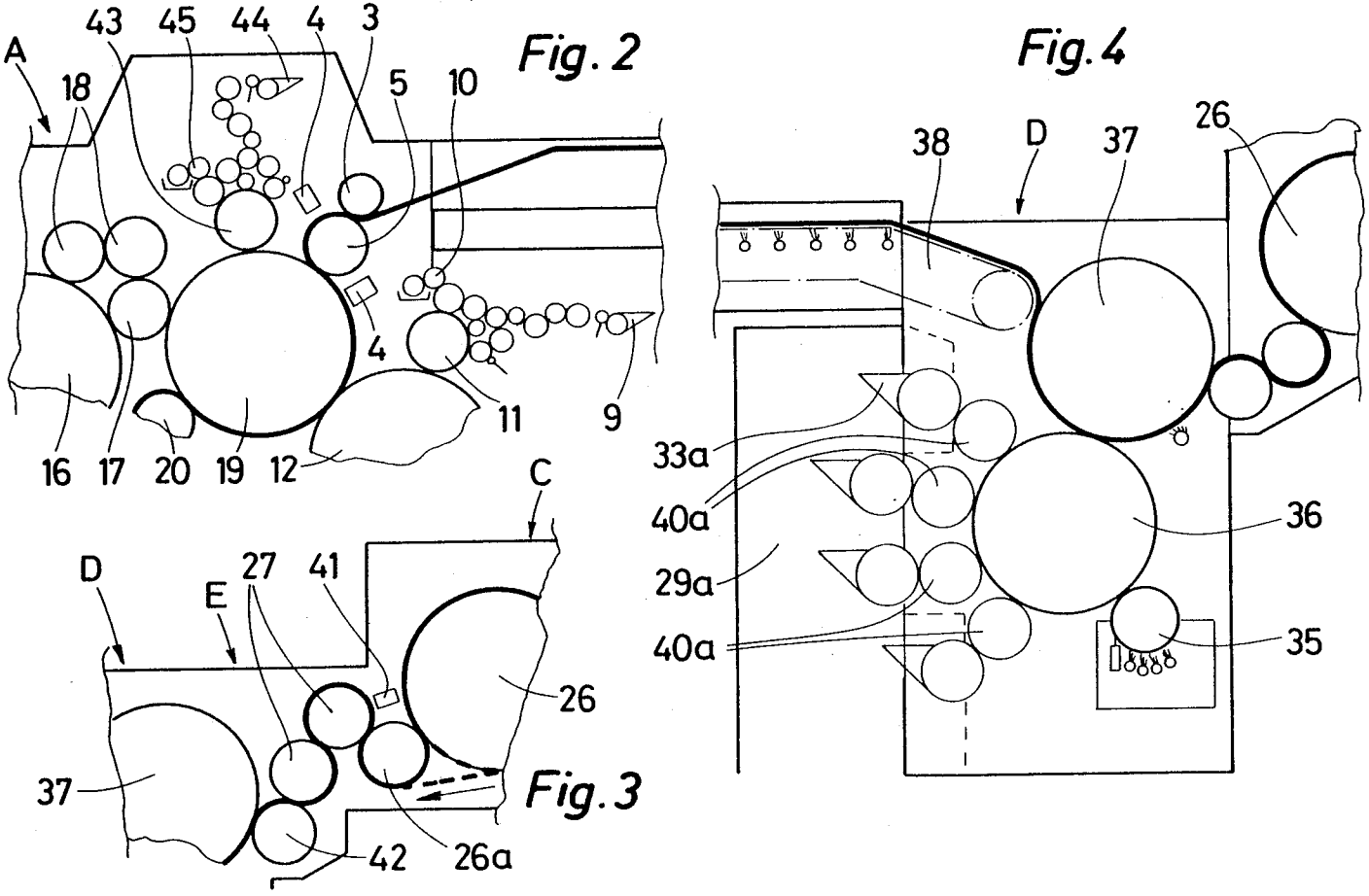
FIG. 2 illustrates diagrammatically, in fragmentary view, an extension of the indirect printing device of FIG. 1*a*, completed by another wet offset printing unit.
FIG. 3 illustrates in fragmentary view a register control and correction device incorporated in the transfer system of the machine between the sheet turning device and the intaglio printing machine.
FIG. 4 shows in fragmentary view another version of the intaglio machine.

In the example shown in FIG. 2 the printing according to the "Orlof" method is completed by a wet offset impression also performed when the sheets pass between blanket cylinders 12 and 19, and is intended more particularly for printing a main monochrome design on currency paper. The wet offset unit comprises an offset plate cylinder 43 provided with an inking unit 44 and with a dampening device 45, both known per se, this offset plate cylinder 43 cooperating with blanket cylinder 18 transferring the image to the sheets. Therefore, in this case there is obtained in a single pass on the left-hand side of the representation according to FIG. 2, a combined printing, for example a four color safety background obtained by printing according to the "Orlof" method and a main monochrome design obtained by wet offset printing.

The thus printed sheets delivered from the indirect printing device A are transferred by a transfer cylinder 20 to a chain gripper system 21 pertaining to the conveyor system feeding the sheets, while preserving the register to the intaglio printing machine D via devices B and C.

The drying device B comprises on the one hand the last section of the rectilinear and vertically arranged chain gripper system 21 along which are ultraviolet lamps 22 intended for drying the side of the sheets printed by offset printing and on the other hand a drying and transfer cylinder 23 comprising along one portion of its periphery ultraviolet lamps 24 adapted to dry the sheet side printed according to the "Orlof" method.

Then, the sheets pass by means of transfer drum 25 to the sheet transfer and turning unit C, known per se, comprising a large cylinder 26 and a small cylinder **26*a*. This device may be adjusted according to needs. In case the sheets must not be turned, they are picked up normally on cylinder 26 by the grippers of cylinder 26*a* which grip their leading edges. In this case, the intaglio printing is made on the offset printing side. In case the sheets must be turned, therefore if they are to be printed with the intaglio method on the "Orlof" printing side, the cylinder 26*a* and its grippers are so controlled that now it is the trailing edge of a sheet that is gripped by the grippers of cylinder 26*a* when the sheet has cleared completely the point of contact between the two cylinders 26,26*a* and when the sheet is still on cylinder 26 of which the gripper hold its leading edge. For this purpose, the grippers of cylinder 26*a* are pivotally mounted about an axis parallel to the cylinder axis and of which the position can be controlled. When the trailing edge of a sheet is gripped by these grippers, the grippers are directed forwards, and during the following rotational movement they are turned in the rear position so that the sheet edge which was the trailing edge on cylinder 26 becomes the leading edge and, when the sheet is in the intermediate position illustrated in dash lines in FIG. 1*b*, the grippers of cylinder 26 release the edge of the sheet whereby, as the rotation of cylinder 26*a*** continues, it is picked up completely by this cylinder.

Then, the sheets, whether turned or not, are fed via a transfer cylinder 27 to the impression cylinder 37 of the intaglio printing machine D. If necessary, a steam spraying device 28 may be provided for ejecting steam on the side of the sheets which is to be printed.

The intaglio machine D illustrated comprises a plate cylinder 36 cooperating in a known fashion with impression cylinder 37. The direction of rotation of the various cylinders is shown by arrows on the drawing. The plate cylinder 36 carries three engraved plates having engraved on their surface for example the main design of the paper to be printed, consisting of two groups of engravings, the one with relatively deep engravings of variable dimensions, the other with very fine grooves consisting mainly of very fine lines or even points, these grooves being shallower than those of the first group.

At the periphery of this plate cylinder 36 and mounted on a movable inking carriage 29 and considered in the direction of rotation, is a smooth-surfaced collecting cylinder 32 transferring the color areas of the image to the fine grooves of the first group; the complete operation of this collecting cylinder and its other features will be described afterwards. Following the collecting cylinder 32, still considered in the direction of rotation, is on the same carriage 29 a conventional selective inking roller 40 having a resilient surface and provided with a one-color inking device 33, and adapted to ink the deep grooves of the second group; this inking roller 40 is so sectioned as to provide relief areas of which the contours correspond exactly to those of the surfaces to be inked.

The inking roller 40 is followed by a prewiping and ink recovery device 34, then by a wiping device 35, both known per se, which clean the surface of the intaglio plate and compress the ink on the grooves.

The collecting cylinder 32 comprises, as already mentioned, a smooth surface and consists of, or is coated with, rubber, for example blankets, or any other resilient material. On this collecting cylinder 32 three different colors for three areas of different colors of the image are transferred, and therefore it cooperates with as many selective color inking cylinders 31 as there are different colors. The surface of these selective cylinders consists of hard materials, such as hard rubber, of plastics or of metal, each selective cylinder 31 being cut out so as to provide relief areas of which the contours corresponds exactly to those of the surfaces to be printed in the respective color. These relief areas are obtained through any known means, for example chemical etching, laser cutting, etc. Since the surface of the selective cylinders is hard, there is no limit to the fineness of the desired inking area. It is even possible to provide inking areas presenting not only very fine lines but also points, a condition unattainable up to now.

Each selective cylinder 31 is associated with an inking device 30 comprising the ink duct proper and color pick-up and distributor rollers.

In the form of embodiment illustrated in the figure, the ratio of the diameters of the selective inking roller 40 or selective cylinders 31 to collecting cylinder 32 and plate cylinder 36 respectively is 1:2:3 and in this case three plates regularly spaced on plate cylinder 36 are provided.

Since the grooves inked by collecting cylinder 32 are not deep, the pressure to be applied thereto by collecting cylinder 32 must be weaker than that exerted by the conventional inking roller 40 to deeper grooves, therefore, though the surface of collecting cylinder 32 is slightly elastic, no distortion of the smooth surface takes place, so that the design can be transferred in perfect register. Similarly, between the selective cylinders 31 and the collecting cylinder 32 only a moderate pressure is needed, this pressure being reduced to substantially a simple contact, thus preventing a distortion of very fine areas cut in the selective cylinders 31.

The chief advantage deriving from this intaglio printing machine D is that it permits of achieving a perfect register between the cuts of the various color areas obtained on selective cylinders 31 of hard material, and that these cylinders are in perfect register with the intaglio plate. Moreover, considering the hard material of selective cylinder 31, there is no limit to the fineness of the design elements. On the other hand, the collecting cylinder permits slight color superpositions in a definitely perfect register. Thus, bank notes or other currency papers are obtained which comprises an intaglio printed main design by means of a very sophisticated configuration and combination of grooves due to the extremely fine grooves that can be provided for by virtue of the collecting inking.

On the other hand, it is quite possible that the first group of very fine grooves inked via the collecting inking can constitute another intaglio safety background completing and/or superposed to the background previously printed either by the offset way or the "Orlof" way. In this case, it is only through the inking roller 40 that a monochrome intaglio main design will be applied.

Due to the fineness of the safety background design obtained through the collecting inking, it is possible to obtain bank notes or any other fiduciary printed papers that are extremely difficult to counterfeit.

FIG. 3 shows an extension of the above-described machine by means of a device for controlling and correcting the register E which is incorporated between the sheet transfer and turning device C and the intaglio printing machine D. This device E comprises a register reading head 41 disposed in front of the sheets passing on the first one of transfer cylinders 27 after leaving the cylinder 26*a* of device C, and a register cylinder 42 disposed between the second transfer cylinder 27 and the impression cylinder 37 of the intaglio printing machine D. The reading head 41 reads the register, respectively a register mark, and if a deviation is detected the register cylinder 42 is controlled by means of an electronic circuit as a function of the reading of the reading head 41 so that a small rotation in one or the other direction will be superposed temporarily to the uniform rotational velocity of transfer of cyinder 42. Of course, this register control device constitutes only an option and is not compulsorily necessary.

The movable inking carriage 29 of the intaglio printing machine D may be replaced by a movable inking carriage 29*a* (FIG. 4) comprising four inking rollers 40*a* each provided with an inking device 33*a* and adapted to ink directly in a conventional manner the intaglio plates of which the grooves are adapted in this case to this direct inking. In this modified version, there is only the wiping device 35 without the necessity of providing a prewiping device.

The combine machine thus permit of printing fiduciary papers, notably bank notes, in a single pass with the following main combinations:

Without turning the sheets

Front side
- background by five-color offset printing, with the possibility of dry and/or wet offset printing;
- main design by four-color intaglio printing, with the possibility of direct and/or collecting inking, or
- variant: another three-color background by intaglio printing with collecting inking and a monochrome design by intaglio printing with direct inking.

Back side
- background by four-color "Orlof" printing, with the possibility of making an additional wet offset print which may either complete the background with a fifth color, or create a monochrome main design.

With sheet turning

Front side
- background by four-color "Orlof" printing, with the possibility of an additional wet offset printing,
- main design by intaglio printing (as mentioned hereinabove with the above-mentioned variant).

Back side
- Background by five-color offset printing, with the possibility of dry and/or wet offset printing, or
- variant: background by four-color offset printing, monochrome main design by wet offset printing.

Moreover, for high-value bank notes, one may contemplate that the intaglio printing by the intaglio printing machine D creates the main multicolor design on the back side and that the sheets subsequently pass in a second passage in another intaglio printing machine printing a multicolor main design on the front side for obtaining in this manner main designs intaglio printed on both sides.

Regarding the drying device B, it is possible, if need be, to dispense with the drying on the side receiving the intaglio print, if for this side a special ink is used in the indirect printing device A.

The above-described machine may also be used as a web printing machine by replacing the sheet transfer means with web transfer means and adapting devices C and E to a paper web. These devices are known. The web turning devices turn the web about a longitudinal axis by inverting the lateral edges. The register control device for paper webs operates with tension rollers and correct the register by modifying the web tension.

What is claimed is:

1. Combined rotary printing machine, notably for printing fiduciary papers, which comprises a multicolor indirect printing device, an intaglio printing machine incorporating a plate cylinder inked in several colors and an impression cylinder, and a paper transfer system adapted to feed the paper printed in said indirect printing device to said intaglio printing machine, wherein:

said indirect printing device is a simultaneous recto-verso printing machine comprising a first blanket cylinder engaging a plurality of offset plate cylinders each inked by an inking unit in a different color, the number of said offset plate cylinders corresponding to the number of colors and designs of the first image to be printed on one of the paper sides, said first image being an image with superposed colors and designs, and a second blanket cylinder operating as a color collecting cylinder engaging a plurality of selective color inking cylinders and a typographic plate cylinder representing the complete design of the second image to be printed on the other side of the paper, said selective color inking cylinders, of which the number corresponds to the number of colors of the second image and of which the relief areas corresponds to the portions of said second image which are to be colored in said different colors, being each inked by an inking device in a different color and applying an image with juxtaposed colors to said collecting cylinder, said collecting cylinder inking in turn said typographic plate cylinder, a third blanket cylinder engaging said typographic plate cylinder and receiving therefrom the image with juxtaposed colors, being adapted to be pressed against said first blanket cylinder, said paper passing between said first and third blanket cylinders so as to be printed simultaneously on both sides with said first and second images, respectively;

a drying device is incorporated in said transfer system, and a sheet transfer and turning device is incorporated in said transfer system between said drying device and said intaglio printing machine for turning said paper as required according as the paper side printed with an image with superposed colors and designs or the paper side printed with juxtaposed colors is to receive an image printed in said intaglio printing machine, wherein the intaglio printing machine is equipped with a movable inking carriage comprising a collecting inking system for several colors and at least one inking roller provided with its inking device for the direct inking of the intaglio plate cylinder, said collecting inking system comprising a collecting cylinder contacting said plate cylinder and inked in turn by several selective color inking cylinders provided each with its proper inking device, said movable carriage being replaceable by a movable carriage having a plurality of inking rollers for the direct inking in several colors.

2. Combined rotary printing machine, notably for printing fiduciary papers, which comprises a multicolor indirect printing device, an intaglio printing machine incorporating a plate cylinder inked in several colors and an impression cylinder, and a paper transfer system adapted to feed the paper printed in said indirect printing device to said intaglio printing machine, wherein: said indirect printing device is a simultaneous recto-verso printing machine comprising a first blanket cylinder engaging a plurality of offset plate cylinders each inked by an inking unit in a different color, the number of said offset plate cylinders corresponding to the number of colors and designs of the first image to be printed on one of the paper sides, said first image being an image with superposed colors and designs, and a second blanket cylinder operating as a color collecting cylinder engaging a plurality of selective color inking cylinders and a typographic plate cylinder representing the complete design of the second image to be printed on the other side of the paper, said selective color inking cylinders, of which the number corresponds to the number of colors of the second image and of which the relief areas corresponds to the portions of said second image which are to be colored in said different colors, being each inked by an inking device in a different color and applying an image with juxtaposed colors to said collecting cylinder, said collecting cylinder inking in turn said typographic plate cylinder, a third blanket cylinder engaging said typographic plate cylinder and receiving therefrom the image with juxtaposed colors, being adapted to be pressed against said first blanket cylinder, said paper passing between said first and third blanket cylinders so as to be printed simultaneously on both sides when said first and second images, respectively;

a drying device is incorporated in said transfer system, a sheet transfer and turning device is incorporated in said transfer system between said drying device and said intaglio printing machine for turning said paper as required according as the paper side printed with an image with superposed colors and designs or the paper side printed with juxtaposed colors is to receive an image printed in said intaglio printing machine, and a collecting inking system for several colors and at least one inking roller provided with its inking device for the direct inking of the intaglio plate cylinder, said collecting inking system comprising a collecting cylinder contacting said plate cylinder and inked in turn by several selective color inking cylinders provided each with its proper inking device, the collecting inking system being replaceable by a plurality of inking devices for the direct inking in several colors.

3. Machine according to claim 2, wherein, a register control and correction device is incorporated in the conveyor system between the paper transfer and turning device and the intaglio printing machine.

4. Machine according to claim 3, wherein, in case of a sheet-fed printing machine, the register control and correction device comprises a register reading head and a register cylinder on which the sheets passing downstream of this head and which is controlled by this head for possibly correcting the register.

5. Machine according to claim 4 wherein the register cylinder is separate from the printing unit and register control and correction is effected by adapting the register cylinder to respond to an electric signal which temporarily changes the rotational speed thereof.

6. Machine according to claim 2, wherein, at least one of said offset plate cylinders of the indirect printing device carries a wet offset printing plate with which a dampening device is associated, whereas the other offset plate cylinders carry dry offset printing plates.

7. Machine according to claim 2, wherein, the indirect printing device further comprises an offset printing unit, preferably a wet offset unit of which the plate cylinder contacts the third blanket cylinder.

8. Machine according to claim 2, wherein, the indirect printing device a double inking system is provided for inking the typographic plate cylinder by means of two image transfer cylinders.

* * * * *